US010168636B2

(12) United States Patent
Ohazama

(10) Patent No.: US 10,168,636 B2
(45) Date of Patent: Jan. 1, 2019

(54) IMAGE FORMING APPARATUS

(71) Applicant: FUJI XEROX CO., LTD., Tokyo (JP)

(72) Inventor: Kazuyasu Ohazama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/803,838

(22) Filed: Nov. 6, 2017

(65) Prior Publication Data

US 2018/0307155 A1 Oct. 25, 2018

(30) Foreign Application Priority Data

Apr. 20, 2017 (JP) ..... 2017-083441

(51) Int. Cl.
*G03G 15/02* (2006.01)

(52) U.S. Cl.
CPC . *G03G 15/0258* (2013.01); *G03G 2215/0448* (2013.01); *G03G 2215/0451* (2013.01); *G03G 2215/0453* (2013.01)

(58) Field of Classification Search
CPC ..... G03G 15/0258; G03G 2215/0448; G03G 2215/0451; G03G 2215/0453
See application file for complete search history.

(56) References Cited

U.S. PATENT DOCUMENTS 6,233,416 B1 * 5/2001 Kinosita ..... G03G 21/06 399/128
6,240,269 B1 * 5/2001 Kaya ..... G03G 13/04 399/127
6,285,385 B1 * 9/2001 Owaki ..... G03G 15/326 347/132
7,421,229 B2 * 9/2008 Tomiie ..... G03G 21/08 399/128

FOREIGN PATENT DOCUMENTS

JP H05-241491 9/1993
JP 2004302155 10/2004
JP 2006234883 9/2006

* cited by examiner

*Primary Examiner* — Rodney Bonnette
(74) *Attorney, Agent, or Firm* — JCIPRNET

(57) ABSTRACT

An image forming apparatus includes a charging member; a light source that includes light source elements and that radiates charge-eliminating light toward the charging member; a processing member that performs a process on the charging member; a function member provided to enable the process of the processing member and disposed between the light source and the charging member, the function member facing a radiation path of the charge-eliminating light and extending in an arrangement direction of the light source elements; and an adjusting portion formed on a surface of the function member that faces the radiation path, the adjusting portion adjusting an amount of irradiation of the charging member by the charge-eliminating light so as to reduce a difference in the amount of irradiation between regions corresponding to arrangement positions of the light source elements and regions between the light source elements.

12 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2017-083441 filed Apr. 20, 2017.

BACKGROUND

Technical Field

The present invention relates to an image forming apparatus.

Summary

According to an aspect of the invention, there is provided an image forming apparatus including a charging member that moves; a light source that includes plural light source elements arranged at a predetermined arrangement pitch and that radiates charge-eliminating light toward the charging member; a processing member that performs a process on a surface of the charging member at a position upstream or downstream of an irradiation region, in which the charging member is irradiated with the charge-eliminating light from the light source, in a direction in which the charging member moves; a function member provided to enable the process of the processing member and disposed between the light source and the charging member at a position spaced from the light source, the function member facing a radiation path of the charge-eliminating light from the light source and extending in an arrangement direction in which the light source elements are arranged; and an adjusting portion formed on a surface of the function member that faces the radiation path, the adjusting portion adjusting an amount of irradiation of the charging member by the charge-eliminating light so as to reduce a difference in the amount of irradiation between regions corresponding to arrangement positions at which the light source elements are arranged and regions between the light source elements.

BRIEF DESCRIPTION OF THE DRAWINGS

Exemplary embodiments of the present invention will be described in detail based on the following figures, wherein.

DETAILED DESCRIPTION

Summary of Exemplary Embodiment

Figure 1A:
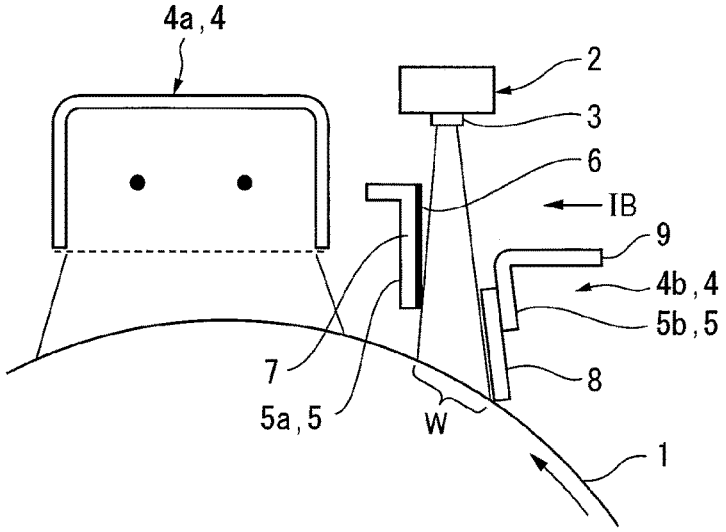
FIG. 1A is a schematic diagram illustrating an image forming apparatus according to an exemplary embodiment of the present invention.
Figure 1B:
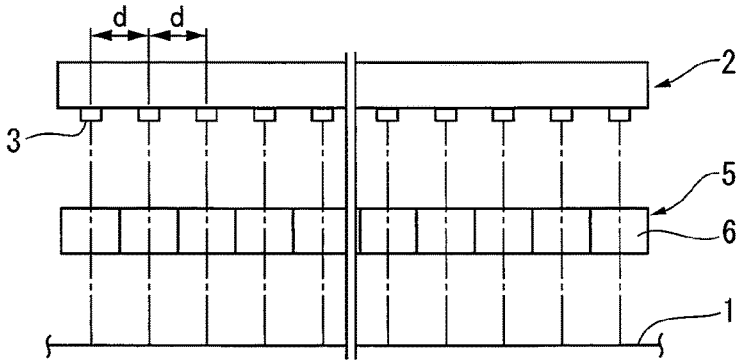
FIG. 1B illustrates the structure of FIG. 1A viewed in the direction of arrow IB.

FIG. 1A is a schematic diagram illustrating an image forming apparatus according to an exemplary embodiment of the present invention. FIG. 1B illustrates the structure of FIG. 1A viewed in the direction of arrow IB.

Referring to FIGS. 1A and 1B, the image forming apparatus includes a charging member 1 that moves, a light source 2, a processing member 4, a function member 5, and an adjusting portion 6. The light source 2 includes plural light source elements 3 arranged at a predetermined arrangement pitch, and radiates charge-eliminating light toward the charging member 1. The processing member 4 performs a process on a surface of the charging member 1 at a position upstream or downstream of an irradiation region W, in which the charging member 1 is irradiated with the charge-eliminating light from the light source 2, in a direction in which the charging member 1 moves. The function member 5 is provided to enable the process of the processing member 4, and is disposed between the light source 2 and the charging member 1 at a position spaced from the light source 2. The function member 5 faces a radiation path of the charge-eliminating light from the light source 2 and extends in an arrangement direction in which the light source elements 3 are arranged. The adjusting portion 6 is formed on a surface of the function member 5 that faces the radiation path and adjusts an amount of irradiation of the charging member 1 by the charge-eliminating light so as to reduce a difference in the amount of irradiation between regions corresponding to arrangement positions at which the light source elements 3 are arranged and regions between the light source elements 3.

In the above-described technical feature, the light source 2 may be installed at any position from which charge-eliminating light is to be radiated. The light source 2 is not limited to those having a simple array structure, and may additionally include a light guiding member or an imaging member. Although the light source elements 3 are typically LEDs, the light source elements 3 are not limited to this.

The processing member 4 may be any device that performs a process on the charging member 1. For example, in an electrophotographic apparatus, the processing member 4 may be any of devices that perform a process on an image carrier that serves as the charging member 1 (for example, charging, exposure, developing, transfer, cleaning, and charge-removing devices). FIG. 1A shows a charging device 4*a*, which charges the charging member 1, and a cleaning device 4*b*, which removes residual substances from the charging member 1, as examples of the processing member 4.

The function member 5 is disposed between the light source 2 and the charging member 1 at a position spaced from the light source 2. In addition, the function member 5 faces the radiation path from the light source 2 and extends in the arrangement direction of the light source elements 3. The fact that the function member 5 is at a position spaced from the light source 2 shows that the function member 5 is not an element of an optical charge-eliminating device (for example, a light-path securing member described in Japanese Unexamined Patent Application Publication No. 2006-234883). The function member 5 defines the radiation path from the light source 2, and extends in the arrangement direction of the light source elements 3. The function member 5 guides the charge-eliminating light from the light source 2 toward the irradiation region W on the charging member 1 without scattering the charge-eliminating light.

The function member 5 is provided to enable the process of the processing member 4. The function member 5 may be provided separately from the processing member 4, or as a portion of the processing member 4 to enable the process of the processing member 4. Referring to FIG. 1A, a light blocking member 7 is an example of the function member 5 (5*a*) that is provided separately from the processing member 4. The light blocking member 7 prevents the charge-eliminating light from irradiating a charging region in which the charging member 1 is charged by the charging device 4*a* disposed adjacent to the light source 2, which is an optical charge-eliminating device. A support member 9 (bracket) is an example of the function member 5 (5*b*) that is provided as a portion of the processing member 4. The support member 9 supports a plate-shaped cleaning member 8 included in the cleaning device 4*b* disposed adjacent to the light source 2, which is an optical charge-eliminating device.

The adjusting portion 6 is formed on the function member 5, which is not an element of the optical charge-eliminating device, and adjusts the amount of irradiation of the charging member 1 by the charge-eliminating light so as to reduce the difference in the amount of irradiation between the regions corresponding to the arrangement positions of the light source elements 3 and the regions between the light source elements 3.

Figure 1C:
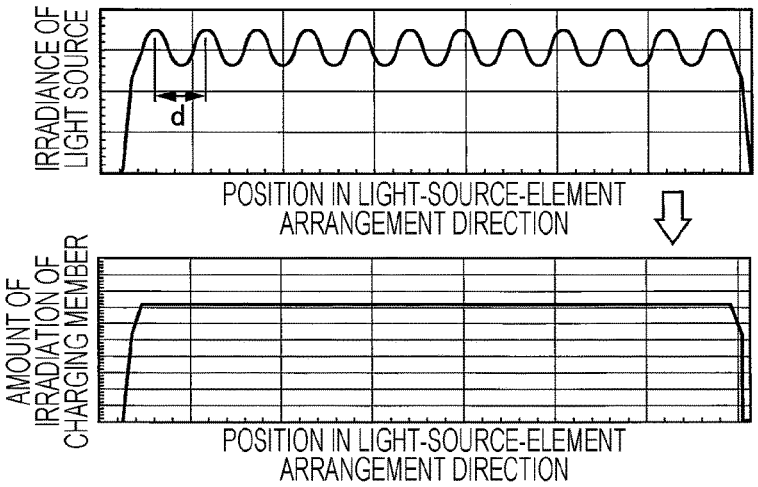
FIG. 1C is a graph showing the relationship between the irradiance distribution of a light source and the distribution of the amount of irradiation of a charging member.

In the image forming apparatus according to the present exemplary embodiment, the light source elements 3 included in the light source 2 are arranged at a predetermined arrangement pitch d, as illustrated in FIG. 1B. Therefore, as illustrated in FIG. 1C, the irradiance of the light source 2 periodically varies between that in regions corresponding to the arrangement positions of the light source elements 3 and that in regions between the light source elements 3.

However, in the present exemplary embodiment, the charge-eliminating light radiated from the light source elements 3 toward the charging member 1 passes the adjusting portion 6 formed on the function member 5, so that the amount of irradiation by the charge-eliminating light is adjusted so as to reduce the difference in the amount of irradiation between the regions corresponding to the arrangement positions of the light source elements 3 and the regions between the light source elements 3. Accordingly, as illustrated in FIG. 1C, the amount of irradiation of the charging member 1 is adjusted so as to be substantially uniform in the arrangement direction of the light source elements 3.

Next, typical examples of the image forming apparatus according to the present exemplary embodiment will be described.

A typical example of the adjusting portion 6 is configured so that the surface of the function member 5 that faces the radiation path has a periodic variation with a period equal to the arrangement pitch d of the light source elements 3. In this example, the adjusting portion 6 varies the amount of irradiation with a period equal to the arrangement pitch d of the light source elements 3 so as to reduce the difference in the amount of irradiation between the regions corresponding to the arrangement positions of the light source elements 3 and the regions between the light source elements 3.

An example of such an adjusting portion 6 is an uneven portion provided on the surface of the function member 5 that faces the radiation path, the uneven portion having the periodic variation with the period equal to the arrangement pitch d of the light source elements 3. In this example, the adjusting portion 6 on the function member 5 has a specific shape in which projections are arranged in regions corresponding to the arrangement positions of the light source elements 3 to reduce the amount of irradiation by reducing the opening width of the radiation path, and in which recesses are arranged in regions between the light source elements 3 to increase the amount of irradiation by increasing the opening width of the radiation path.

A typical example of the uneven portion, which is the adjusting portion 6, has a wavy or substantially wavy shape with a sinusoidal or substantially sinusoidal cross section. Another typical example of the uneven portion, which is the adjusting portion 6, has a wavy or substantially wavy shape with a rectangular-wave-shaped or substantially rectangular-wave-shaped cross section.

Another typical example of the adjusting portion 6 has a reflection intensity distribution on the surface of the function member 5 that faces the radiation path, the reflection intensity distribution having the periodic variation with the period equal to the arrangement pitch d of the light source elements 3. In this example, the reflection intensity distribution of the adjusting portion 6 varies the amount of irradiation with a period equal to the arrangement pitch d of the light source elements 3 so as to reduce the difference in the amount of irradiation between the regions corresponding to the arrangement positions of the light source elements 3 and the regions between the light source elements 3. More specifically, portions having a low reflection intensity are arranged in regions corresponding to the arrangement positions of the light source elements 3 to reduce the amount of irradiation, and portions having a high reflection intensity are arranged in regions between the light source elements 3 to increase the amount of irradiation.

When the adjusting portion 6 is formed on the function member 5, the adjusting portion 6 may be formed at least on an end portion of the function member 5 that is adjacent to the charging member 1. In this example, since the adjusting portion 6 is formed at least on the end portion of the function member 5 that is adjacent to the charging member 1, the amount of irradiation is adjusted in a region close to the charging member 1.

The adjusting portion 6 may correct the amount of irradiation by the charge-eliminating light so as to reduce a difference in the amount of irradiation by the charge-eliminating light between an end portion and a central portion in the arrangement direction of the light source elements 3. In the case where, for example, the adjusting portion 6 has a shape or a reflection intensity distribution having the periodic variation with the period equal to the arrangement pitch d of the light source elements 3, the amount of irradiation in regions corresponding to end portions in the arrangement direction of the light source elements 3 tends to be smaller than that in other regions because the adjusting portion 6 is absent in regions outside the end portions. Accordingly, in this example, the amount of irradiation by the charge-eliminating light may be corrected so as to reduce the difference in the amount of irradiation by the charge-eliminating light between the end portions and the central portion in the arrangement direction of the light source elements 3 by using the adjusting portion 6 in which the end portions thereof have a structure different from that of other portions. For example, when the adjusting portion 6 is an uneven portion, the amount of irradiation may be increased by increasing the depth of the recesses. When the adjusting portion 6 has a reflection intensity distribution, the amount of irradiation may be increased by increasing the reflection intensity.

In the case where the function member 5 is provided separately from the processing member 4 (5*a* in this example), the processing member 4 may be the charging device 4*a* that is adjacent to the light source 2 and that charges the charging member 1, and the function member 5 may be the light blocking member 7 that prevents the charge-eliminating light from the light source 2 from irradiating the charging region in which the charging member 1 is charged by the charging device 4*a*. In this example, the light blocking member 7, which is the function member 5 required to enable the process of the charging device 4*a* that serves as the processing member 4, is used. The light blocking member 7 prevents the charge-eliminating light from the light source 2 that serves as the optical charge-eliminating device from irradiating the charging region in which the charging member 1 is charged by the charging device 4*a*. In a typical configuration, the charging device 4*a* is disposed downstream of the irradiation region W, in which the charging member 1 is irradiated by the charge-eliminating light from the light source 2, in the direction in which the charging member 1 moves. The charging member 1 is charged to a predetermined level after the charge level thereof is reset, so that the charging member 1 may be accurately charged to the predetermined level by the charging device 4*a*.

In a typical configuration including the light blocking member 7, which is the function member 5 required to enable the process of the charging device 4*a* that serves as the processing member 4, the adjusting portion 6 may be integrated with the light blocking member 7. In this example, the adjusting portion 6 provided on the light blocking member 7, which is required to enable the process of the charging device 4*a*, adjusts the amount of irradiation by the charge-eliminating light by allocating the amount of light to be blocked.

In the case where the function member 5 is provided as a portion of the processing member 4 (5*b* in this example), the processing member 4 may be the cleaning device 4*b* that is adjacent to the light source 2 and that includes the plate-shaped cleaning member 8 that is in contact with the charging member 1, and the function member 5 may be the support member 9 that supports the plate-shaped cleaning member 8. In this example, a portion of the cleaning device 4*b* that serves as the processing member 4 is used as the function member 5. In a typical configuration, the cleaning device 4*b* is disposed upstream of the irradiation region W, in which the charging member 1 is irradiated by the charge-eliminating light from the light source 2 that serves as the optical charge-eliminating device, in the direction in which the charging member 1 moves. The charging member 1 is subjected to the charge-eliminating process performed by the light source 2 after the surface thereof is cleaned. The cleaning device may instead be disposed downstream of the irradiation region W, in which the charging member 1 is irradiated by the charge-eliminating light from the light source 2, in the direction in which the charging member 1 moves.

In a typical configuration including the cleaning device 4*b* that serves as the processing member 4, the adjusting portion 6 may be provided on the support member 9 (which corresponds to the function member 5) for supporting the plate-shaped cleaning member 8.

The present invention will be described in more detail based on exemplary embodiments illustrated in the accompanying drawings.

First Exemplary Embodiment

Overall Structure of Image Forming Apparatus

Figure 2:
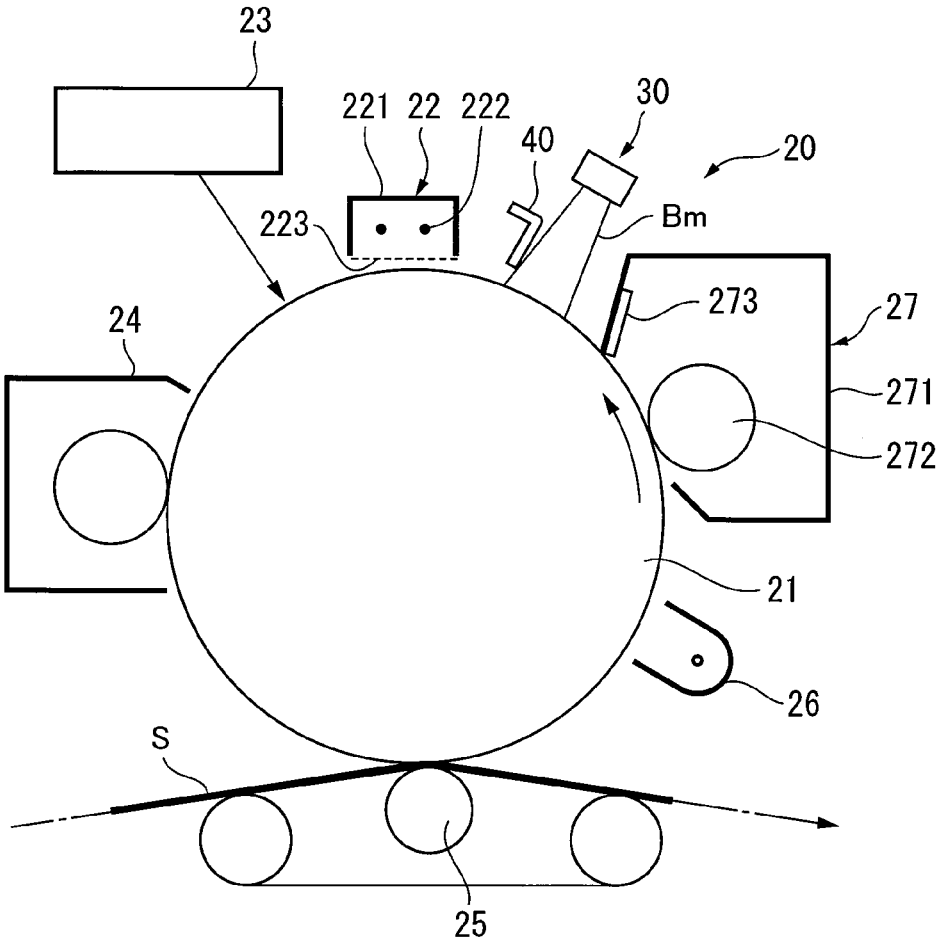
FIG. 2 illustrates the overall structure of an image forming apparatus according to a first exemplary embodiment.

FIG. 2 illustrates the overall structure of an image forming apparatus 20 according to a first exemplary embodiment.

Referring to FIG. 2, the image forming apparatus 20 includes a photoconductor 21, a charging device 22, a latent-image writing device 23, a developing device 24, a transfer device 25, a pre-cleaning charging device 26, a cleaning device 27, and an optical charge-eliminating device 30. The photoconductor 21 is drum-shaped and serves as a charging member that rotates. The charging device 22 charges the photoconductor 21. The latent-image writing device 23 is, for example, a laser scanning device or an LED writing head that writes an electrostatic latent image on the photoconductor 21 charged by the charging device 22. The developing device 24 develops the electrostatic latent image written by the latent-image writing device 23 by using predetermined toner. The transfer device 25 is, for example, a belt transfer device that transfers the toner image developed by the developing device 24 onto a recording medium S. The pre-cleaning charging device 26 is composed of a pre-cleaning charger (PCC) that causes the residual substances that remain on the photoconductor 21 after the transfer process to have the same polarity before being removed. The cleaning device 27 removes the residual substances from the photoconductor 21 after the residual substances are processed so as to have the same polarity by the cleaning charging device 26. The optical charge-eliminating device 30 eliminates the residual charge on the photoconductor 21 cleaned by the cleaning device 27.

Configuration around Optical Charge-Eliminating Device

In the present exemplary embodiment, as illustrated in FIG. 2, the charging device 22 is disposed downstream of the optical charge-eliminating device 30 in a rotation direction of the photoconductor 21, and is composed of, for example, a scorotron. More specifically, the charging device 22 includes a charging housing 221 having an opening that faces the photoconductor 21; discharge wires 222 disposed in the charging housing 221; and a mesh control electrode 223 for controlling a charge potential that is disposed at the opening in the charging housing 221 that faces the photoconductor 21. The electric charge emitted from the discharge wires 222 is applied to the photoconductor 21 so that the surface of the photoconductor 21 is charged to a predetermined charge potential.

Figure 3:
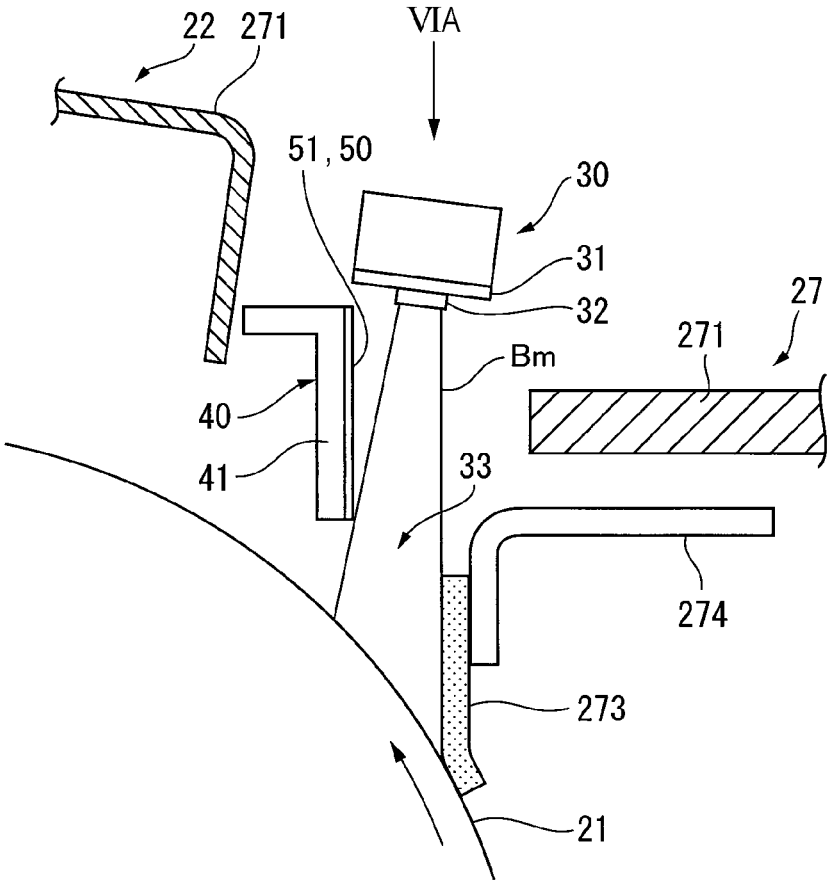
FIG. 3 illustrates the area around an optical charge-eliminating device included in the image forming apparatus illustrated in FIG. 2.

As illustrated in FIGS. 2 and 3, a light blocking plate 40 is disposed between the charging device 22 and the optical charge-eliminating device 30. In this example, the light blocking plate 40 is a plate member having an L-shaped cross section. The light blocking plate 40 is, for example, fixed at a position spaced from the optical charge-eliminating device 30 by a bracket (not shown), and blocks the charge-eliminating light radiated from the optical charge-eliminating device 30 toward the photoconductor 21 so that the charge-eliminating light does not reach the charging region of the charging device 22. Therefore, the light blocking plate 40 is a member required to enable the charging process performed by the charging device 22, and is disposed so as to face the radiation path of the charge-eliminating light from the optical charge-eliminating device 30 at a side of the radiation path that is adjacent to the charging device 22.

As illustrated in FIGS. 2 and 3, the cleaning device 27 is disposed upstream of the optical charge-eliminating device 30 in the rotation direction of the photoconductor 21, and includes a cleaning housing 271 having an opening that faces the photoconductor 21. A rotatable cleaning brush 272, which in contact with the surface of the photoconductor 21, is disposed in the cleaning housing 271. A plate-shaped cleaning blade 273 is disposed downstream of the cleaning brush 272 in the rotation direction of the photoconductor 21. The plate-shaped cleaning blade 273 is fixed to the cleaning housing 271 by, for example, a support bracket 274 having an L-shaped cross section.

In this example, the cleaning blade 273 is arranged so that a distal end portion thereof extends in a direction opposite to the rotation direction of the photoconductor 21, and is disposed so as to face the radiation path of the charge-eliminating light from the optical charge-eliminating device 30 at a side of the radiation path that is adjacent to the cleaning device 27.

Exemplary Structure of Optical Charge-Eliminating Device

Figure 4A:
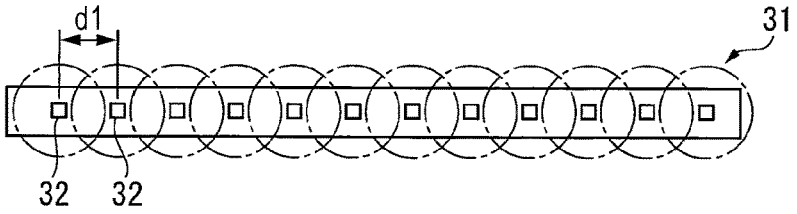
FIG. 4A illustrates an LED array included in the optical charge-eliminating device.
Figure 4B:
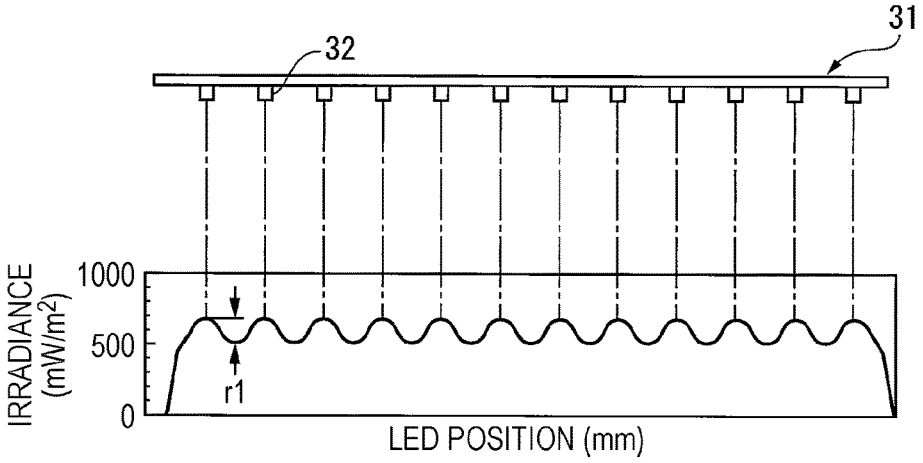
FIG. 4B is a graph showing the irradiance distribution of the LED array.

As illustrated in FIGS. 3 and 4A, the optical charge-eliminating device 30 according to the present exemplary embodiment includes an LED array 31 that is substantially parallel to an axial direction of the photoconductor 21. The LED array 31 includes plural LEDs 32 arranged at a predetermined arrangement pitch d1. The arrangement pitch d1 of the LEDs 32 included in the LED array 31 may be, for example, about 25 to 35 (mm), which corresponds to a relatively low density. Accordingly, in this example, as illustrated in FIG. 4B, the irradiance of the LED array 31 varies with a period equal to the arrangement pitch d1 of the LEDs 32, and a ripple (range of irradiance distribution) r1, which corresponds to the difference between local maximum values and local minimum values, is as large as about 200 $mW/m^2$, for example.

Figure 4C:
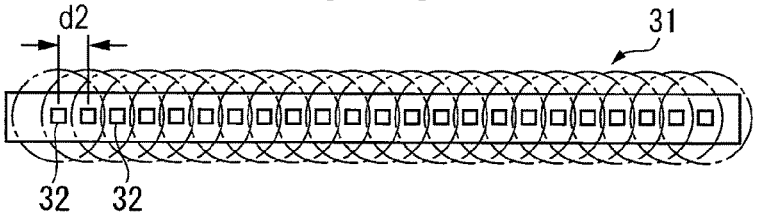
FIG. 4C illustrates an example in which an LED arrangement pitch of the LED array illustrated in FIG. 4A is reduced.
Figure 4D:
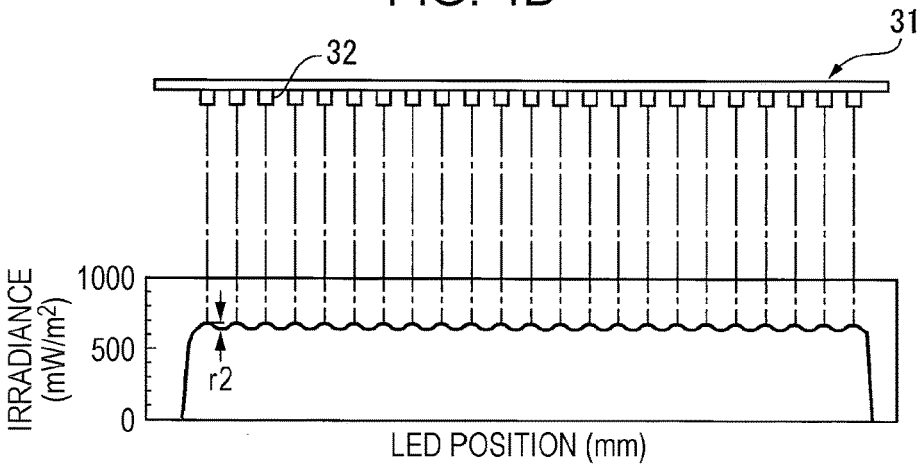
FIG. 4D is a graph showing the irradiance distribution of the LED array illustrated in FIG. 4C.

When, for example, the LEDs 32 of the LED array 31 are arranged at an arrangement pitch d2 (for example, d1/2≥d2) as illustrated in FIG. 4C, the irradiance of the LED array 31 varies with a period equal to the arrangement pitch d2 of the LEDs 32, as illustrated in FIG. 4D. Since the arrangement pitch d2 of the LEDs 32 is smaller than that in the arrangement illustrated in FIG. 4A, the ripple r2 is sufficiently reduced to, for example, 50 $mW/m^2$ or less. However, the number of LEDs 32 needs to be increased to sufficiently reduce the ripple r2 of the irradiance distribution of the LED array 31. Accordingly, the cost of the LED array 31 will be increased.

In the present exemplary embodiment, to prevent an increase in the cost of the LED array 31, the optical charge-eliminating device 30 includes the LED array 31 illustrated in FIG. 4A in which the arrangement pitch d1 of the LEDs 32 corresponds to a relatively low density.

Exemplary Structure of Adjusting Portion

In the present exemplary embodiment, as illustrated in FIG. 3, the light blocking plate 40 defines a slit-shaped opening 33, which serves as a radiation path of charge-eliminating light Bm from the LED array 31, between the cleaning blade 273 of the cleaning device 27 and the light blocking plate 40. The light blocking plate 40 includes a partition plate portion 41 that faces the slit-shaped opening 33. An adjusting portion 50, which adjusts the amount of irradiation by the light from LED array 31, is formed on the partition plate portion 41.

Figure 5A:
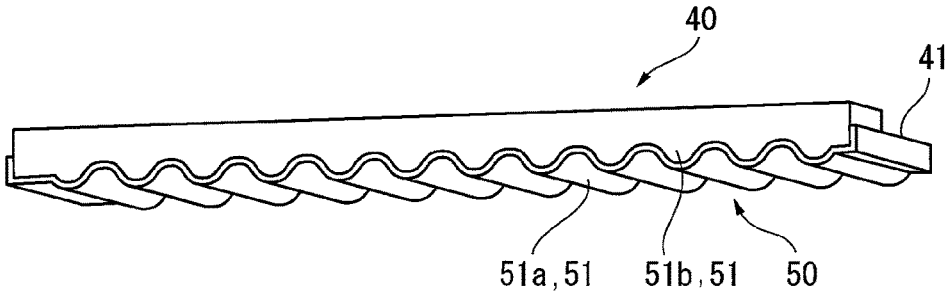
FIG. 5A illustrates the structure of a light blocking plate according to the first exemplary embodiment.
Figure 6A:
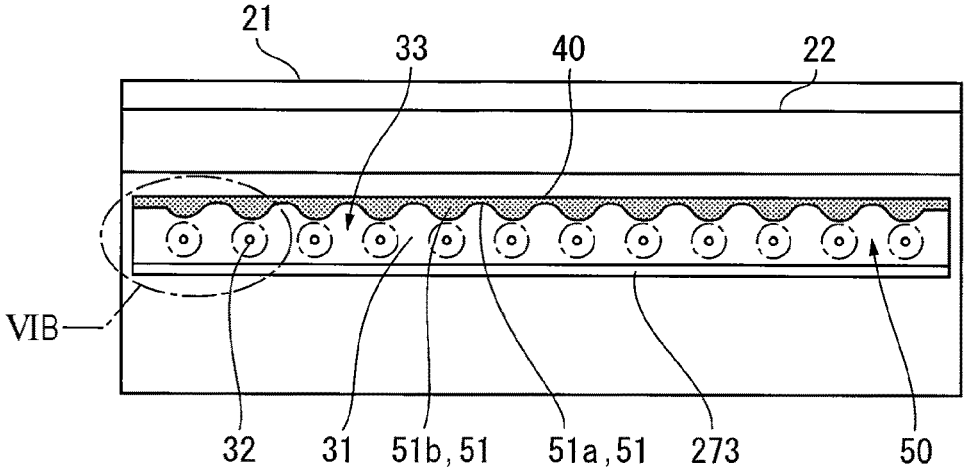
FIG. 6A illustrates the structure of FIG. 3 viewed in the direction of arrow VIA.
Figure 6B:
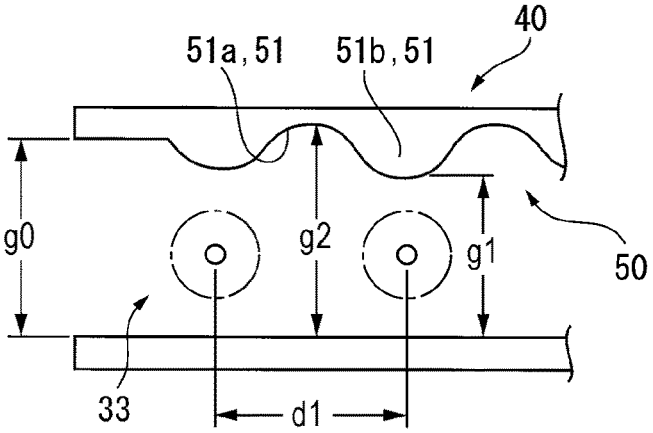
FIG. 6B is an enlarged view of part VIB in FIG. 6A.

In this example, as illustrated in FIGS. 5A, 6A, and 6B, the adjusting portion 50 includes an uneven portion 51 (recesses 51*a* and projections 51*b*) having a periodic variation with a period equal to the arrangement pitch d1 of the LEDs 32. The uneven portion 51 has a wavy shape with a sinusoidal cross section. The projections 51*b* are arranged in regions corresponding to the arrangement positions of the LEDs 32, and the width of the slit-shaped opening 33 between the projecting end of each projection 51*b* and the cleaning blade 273 is set to g1. The recesses 51*a* are arranged in regions between the LEDs 32, and the width of the slit-shaped opening 33 between the deepest portion of each recess 51*a* and the cleaning blade 273 is set to g2 (g2>g1). A slit-shaped opening area M1 per width of each of the projections 51*b* arranged in the regions corresponding to the positions of the LEDs 32 and a slit-shaped opening area M2 per width of each of the recesses 51*a* arranged in the regions between the LEDs 32 satisfy M1<M2. In this example, the width between the cleaning blade 273 and each of the positions corresponding to the zero-cross points of the uneven portion 51 is set to g0 (g1<g0<g2).

A method for calculating exposure energy applied to the photoconductor 21 by the LED array 31 will now be described.

Figure 7A:
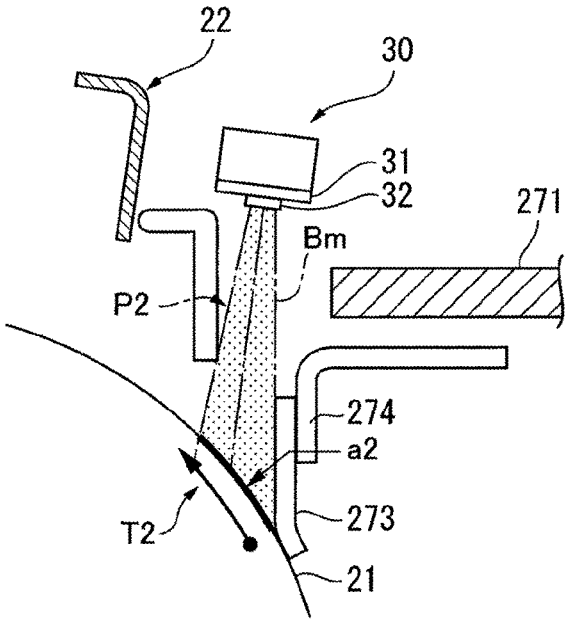
FIG. 7A illustrates a method for determining exposure energy in an irradiation region in which a photoconductor surface is irradiated with light from the optical charge-eliminating device.

First, referring to FIG. 7A, irradiation of the surface of the photoconductor 21 by the charge-eliminating light Bm from the LED array 31 will be discussed. When the irradiance of the LED array 31 on the surface of the photoconductor 21 is P2 (mW/m$^2$), the irradiation width in a sub-scanning direction is a2 (mm), the irradiation-region passage time of the surface of the photoconductor 21 (which corresponds to the exposure time) is T2 (sec), the process speed of the photoconductor 21 is PS, and the exposure energy applied to the photoconductor 21 is E2, the following equations are satisfied:

$$E2=P2\times T2 \quad (1)$$

$$T2=a2\div PS \quad (2)$$

The following equation is derived from Equations (1) and (2):

$$E2=P2\times a2\div PS \quad (3)$$

Figure 7B:
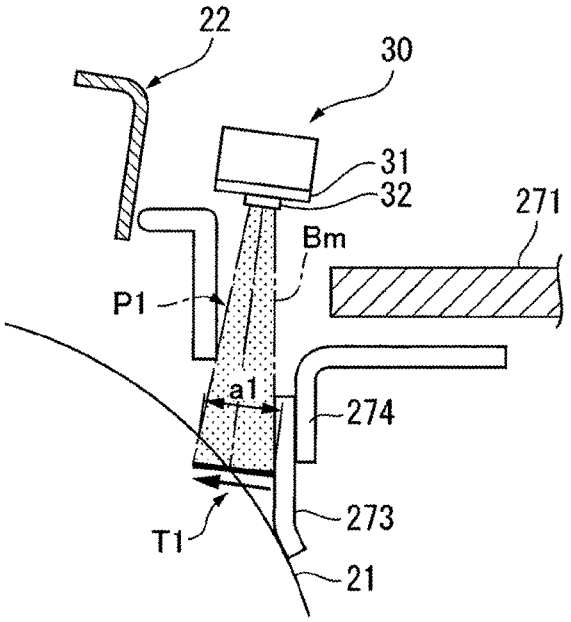
FIG. 7B illustrates a method for determining exposure energy on a reference perpendicular plane that corresponds to the irradiation region in which the photoconductor surface is irradiated with light from the optical charge-eliminating device.

Referring to FIG. 7B, assume that the irradiation region in which the surface of the photoconductor 21 is irradiated by the charge-eliminating light Bm from the LED array 31 is replaced by an irradiation region on a reference perpendicular plane that perpendicularly crosses the optical axis of the LED array 31 on the surface of the photoconductor 21. When the irradiance of the LED array 31 on the reference perpendicular plane is P1 (mW/m$^2$), the irradiation width in the sub-scanning direction is a1 (mm), the irradiation-region passage time of the reference perpendicular plane (which corresponds to the exposure time) is T1 (sec), the process speed of the photoconductor 21 is PS, and the exposure energy applied to the photoconductor 21 is E1, the following equations are satisfied:

$$E1=P1\times T1 \quad (4)$$

$$T1=a1\div PS \quad (5)$$

The following equation is derived from Equations (4) and (5):

$$E1=P1\times a1\div PS \quad (6)$$

Since P2=Pixal/a2, T2=a2/PS, and T1=a1/PS, the following expression is derived from Equations (3) and (6):

$$E2\approx E1 \quad (7)$$

The exposure energy E2 applied to the photoconductor 21 by the LED array 31 may be made substantially uniform by adjusting the exposure energy E1 in the irradiation region on the reference perpendicular plane as follows. That is, the width of the slit-shaped opening 33 defined by the adjusting portion 50 may be varied between g1 and g2 so that the slit-shaped opening area is varied between M1 and M2 in accordance with the distribution of the irradiance P1 of the LED array 31, which periodically varies with a period equal to the mounting pitch of the LEDs 32 (which corresponds to the arrangement pitch d1 in FIG. 4A). Thus, the irradiation width al in the sub-scanning direction of the LED array 31 is adjusted so that the irradiation width al varies at a period equal to the arrangement pitch d1 of the LEDs 32 so as to reduce a difference in the amount of irradiation between the regions corresponding to the arrangement positions of the LEDs 32 and the regions between the LEDs 32.

Figure 8A:
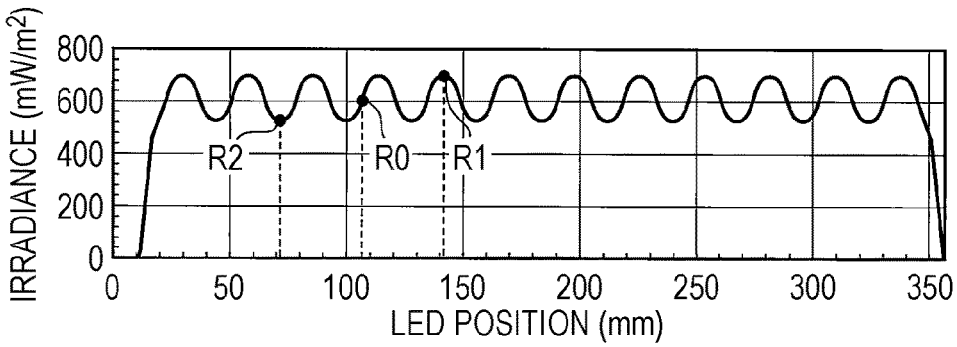
FIG. 8A is a graph showing the irradiance distribution on the photoconductor surface in an LED arrangement direction of the LED array included in the optical charge-eliminating device.

More specifically, assume that the irradiance of the LED array 31 on the photoconductor surface periodically varies with a period equal the arrangement pitch d1 of the LEDs 32, as illustrated in FIG. 8A.

For example, assume that P2=697.2 (mW/m$^2$) in regions R1 corresponding to the arrangement positions of the LEDs 32, P2=522.9 (mW/m$^2$) in regions R2 between the LEDs 32, and P2=610.0 (mW/m$^2$) in regions RO at the midpoints between the regions R1 and R2.

Figure 8B:
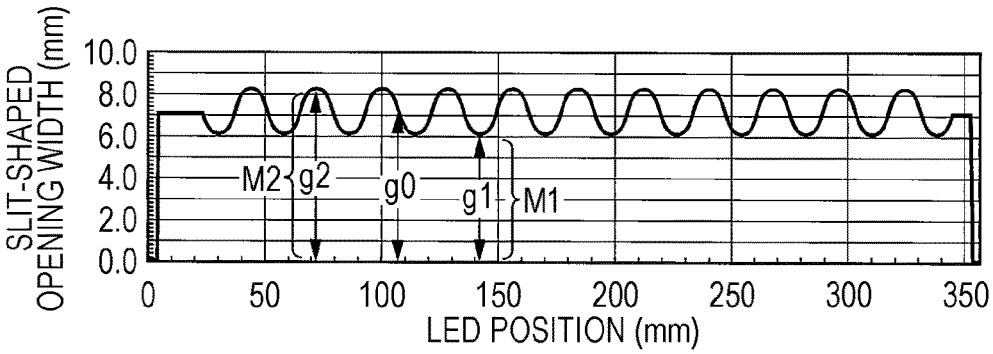
FIG. 8B is a graph showing the width distribution of a slit-shaped opening between the light blocking plate and a cleaning blade in the LED arrangement direction.

In this case, the width distribution of the slit-shaped opening 33 defined by the uneven portion 51 of the adjusting portion 50 may be set so that, as illustrated in FIG. 8B, g0=7.1 (mm), g1=6.2 (mm), and g2=8.3 (mm) at positions corresponding to the regions R0, R1, and R2, respectively.

Figure 8C:
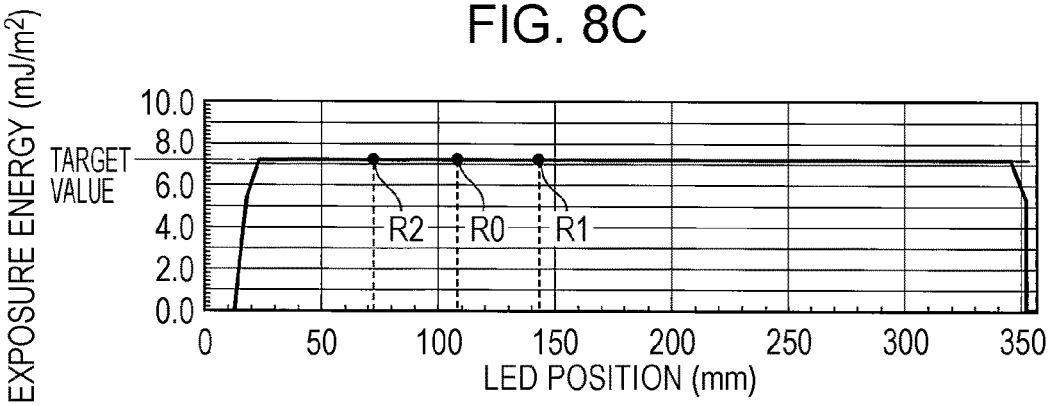
FIG. 8C is a graph showing the exposure energy distribution on the photoconductor surface in the LED arrangement direction.

When the adjusting portion 50 is set as described above, the exposure energy E2 on the photoconductor surface is maintained substantially uniform, as illustrated in FIG. 8C.

When the process speed of the photoconductor 21 is 600 mm/sec, the exposure energy E2 on the photoconductor surface in each of the regions R0 to R2 may be calculated as follows.

In region R0, E2=610 mW/m$^2$×(7.1 mm÷600 mm/sec) =7.2 mJ/m$^2$.

In region R1, E2=697.2 mW/m$^2$×(6.2 mm+600 mm/sec) =7.2 mJ/m$^2$.

In region R2, E2=522.9 mW/m$^2$×(8.3 mm+600 mm/sec) =7.2 mJ/m$^2$.

Thus, the irradiation-region passage time T2 of the surface of the photoconductor 21 (which corresponds to the exposure time) may be corrected by changing the width of the slit-shaped opening 33 defined by the adjusting portion 50 so as to correct the slit-shaped opening area M (for example, M1 and M2) in accordance with the irradiance distribution of the LED array 31 in the arrangement direction. As a result, the exposure energy distribution on the photoconductor 21 may be maintained substantially uniform.

COMPARATIVE EXAMPLE

To evaluate the performance of the image forming apparatus according to the present exemplary embodiment, an image forming apparatus according to a comparative example will be described.

Figure 9A:
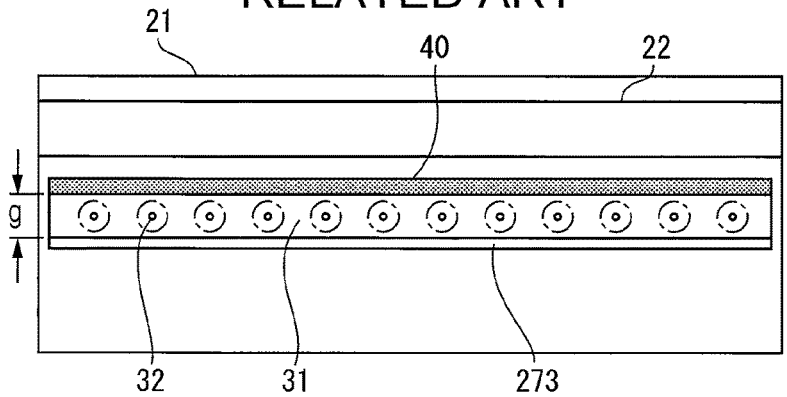
FIG. 9A RELATED ART
FIG. 9A is a schematic diagram corresponding to FIG. 6A, illustrating the area around an optical charge-eliminating device included in the image forming apparatus according to the comparative example.
Figure 9B:
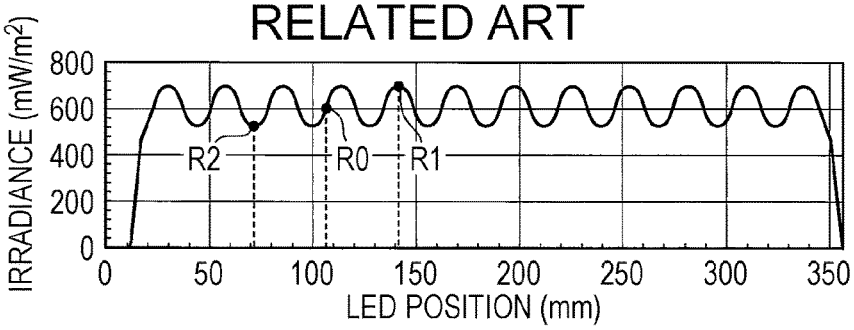
FIG. 9B RELATED ART
FIG. 9B is a graph showing the irradiance distribution on a photoconductor surface in an LED arrangement direction of an LED array included in the optical charge-eliminating device illustrated in FIG. 9A.
Figure 9C:
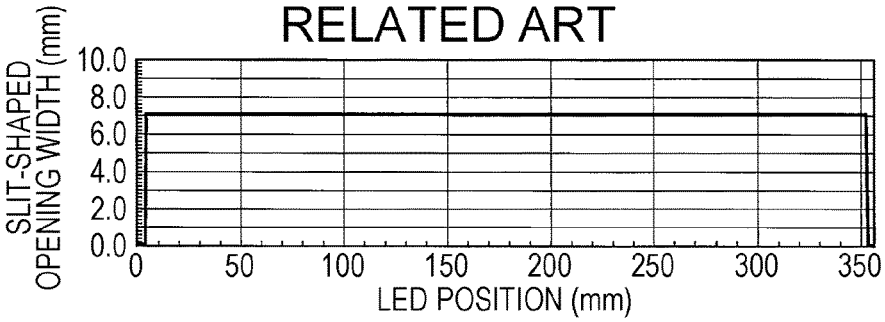
FIG. 9C RELATED ART
FIG. 9C is a graph showing an example of the width distribution of a slit-shaped opening between a light blocking plate and a cleaning blade in the LED arrangement direction.

As illustrated in FIGS. 9A and 9C, according to this comparative example, the light blocking plate 40 disposed between the charging device 22 and the optical charge-eliminating device 30 does not include the uneven portion 51 that serves as the adjusting portion 50. Components similar to those in the first exemplary embodiment are denoted by the same reference numerals as those in the first exemplary embodiment, and detailed description thereof will be omitted.

In this comparative example, as illustrated in FIGS. 9A and 9C, the slit-shaped opening between the light blocking plate 40 and the cleaning blade 273 of the cleaning device 27 has a constant width g.

Figure 9D:
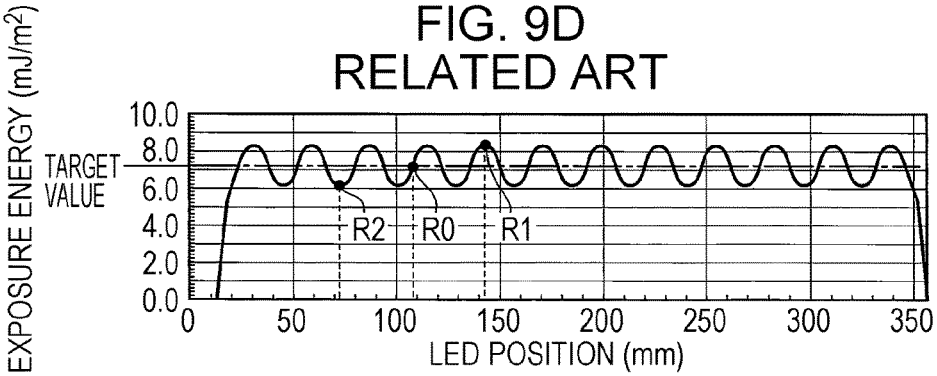
FIG. 9D RELATED ART
FIG. 9D is a graph showing the exposure energy distribution on the photoconductor surface in the LED arrangement direction.

As illustrated in FIG. 9B, the irradiance P1 of the LED array 31 periodically varies with a period equal to the mounting pitch of the LEDs 32 (which corresponds to the arrangement pitch d1 in FIG. 4A). Since the slit-shaped opening between the light blocking plate 40 and the cleaning blade 273 has a constant width g, as illustrated in FIG. 9B, the charge-eliminating light Bm from the LED array 31 irradiates the photoconductor 21 while the distribution of the irradiance P1 that periodically varies is maintained and while the amount of irradiation remains unchanged. Therefore, as illustrated in FIG. 9D, the exposure energy on the surface of the photoconductor 21 periodically varies relative to the target value with a period equal to the arrangement pitch d1 of the LEDs 32 included in the LED array 31. Thus, the exposure energy cannot be made uniform.

First Modification

Figure 5B:
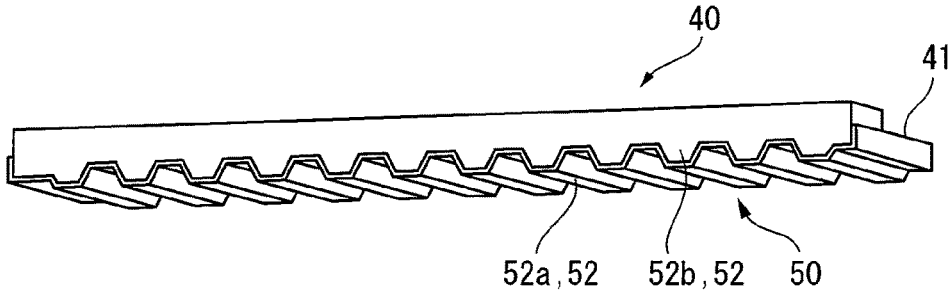
FIG. 5B illustrates the structure of a light blocking plate according to a first modification.
Figure 5C:
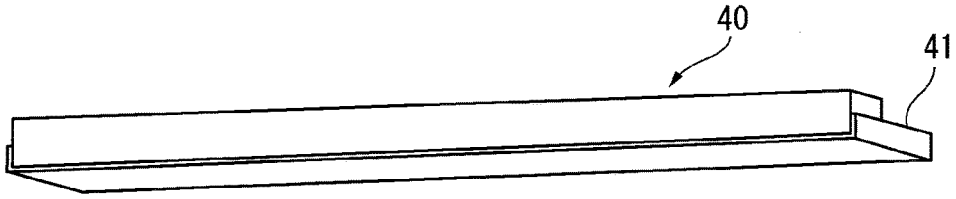
FIG. 5C PRIOR ART
FIG. 5C illustrates an example of a light blocking plate included in an image forming apparatus according to a comparative example.

In the present exemplary embodiment, the adjusting portion 50 formed on the light blocking plate 40 includes the uneven portion 51 having a wavy shape with a sinusoidal cross section. However, the adjusting portion 50 is not limited to this. As illustrated in FIG. 5B, the adjusting portion 50 may instead include an uneven portion 52 (recesses 52*a* and projections 52*b*) having a rectangular-wave-shaped cross section.

According to this modification, the slit-shaped opening area M between the light blocking plate 40 and the cleaning blade 273 may be changed more sharply than in the first exemplary embodiment (in which the uneven portion 51 is used as the adjusting portion 50). Therefore, the uneven portion 51 according to the first exemplary embodiment may be used when the slit-shaped opening area M is to be changed gently to correct the distribution of the irradiance P1 of the LED array 31, and the uneven portion 52 according to the first modification may be used when the slit-shaped opening area M is to be changed sharply to correct the distribution of the irradiance P1 of the LED array 31.

Second Modification

In the present exemplary embodiment, the adjusting portion 50 formed on the light blocking plate 40 includes the uneven portion 51 whose end portions and central portion in the arrangement direction of the LEDs 32 of the LED array 31 have the same structure. Since the uneven portion 51 is absent in regions outside the end portions in the arrangement direction of the LEDs 32 of the LED array 31, the amount of irradiation in regions corresponding to the end portions tends to be smaller than that in other regions.

Figure 10A:
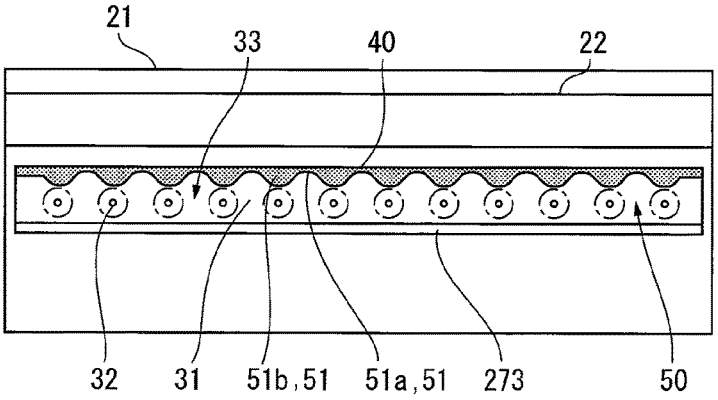
FIG. 10A is a schematic diagram corresponding to FIG. 6A, illustrating a second modification in which the structure around an optical charge-eliminating device of an image forming apparatus is partially changed from that in the first exemplary embodiment.
Figure 10B:
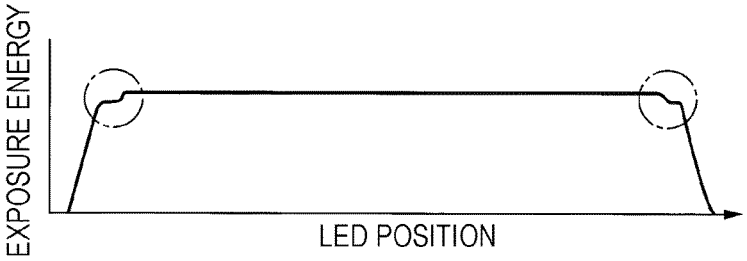
FIG. 10B is a graph showing the exposure energy distribution on a photoconductor surface in an LED arrangement direction of an LED array included in the optical charge-eliminating device illustrated in FIG. 10A.

Accordingly, as illustrated in FIGS. 10A and 10B, there is a risk that the exposure energy of the charge-eliminating light Bm from the LED array 31 will be reduced at the end portions in the arrangement direction of the LEDs 32 of the LED array 31 and that the uniformity of the exposure energy distribution will be reduced.

Figure 10C:
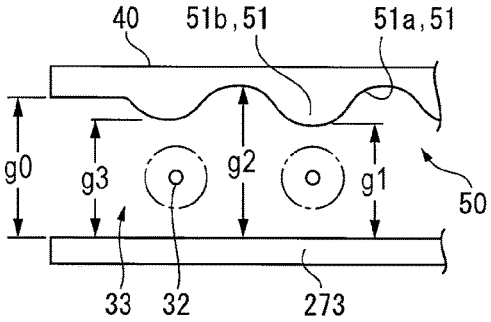
FIG. 10C illustrates an example of a manner in which the width of a slit-shaped opening between a light blocking plate and a cleaning blade is varied in the region around an end portion in the LED arrangement direction.
Figure 10D:
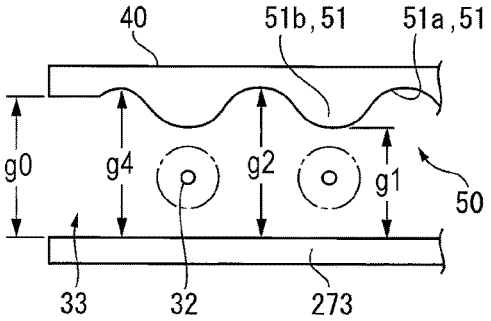
FIG. 10D illustrates an example other than that illustrated in FIG. 10C.

To reduce such a risk, according to a second modification illustrated in FIGS. 10A and 10C or in FIGS. 10A and 10D, the amount of irradiation may be increased in the regions corresponding to the end portions in the arrangement direction of the LEDs 32 of the LED array 31.

In the example illustrated in FIGS. 10A and 10C, the uneven portion 51, which serves as the adjusting portion 50, is formed so that the width of the slit-shaped opening 33 is set to g3 (g3>g1) in each of the regions corresponding to the end portions in the arrangement direction of the LEDs 32 of the LED array 31 (in this example, these regions correspond to the arrangement positions of the LEDs 32). Accordingly, the amount of irradiation is increased.

In the example illustrated in FIGS. 10A and 10D, the uneven portion 51, which serves as the adjusting portion 50, is formed so that the width of the slit-shaped opening 33 is set to g4 (g2>g4>g0) in each of the regions corresponding to the end portions in the arrangement direction of the LEDs 32 of the LED array 31 (in this example, these regions are outside the arrangement positions of the LEDs 32). Accordingly, the amount of irradiation is increased in the regions outside the LEDs 32 at the ends of the LED array 31.

Second Exemplary Embodiment

Figure 11A:
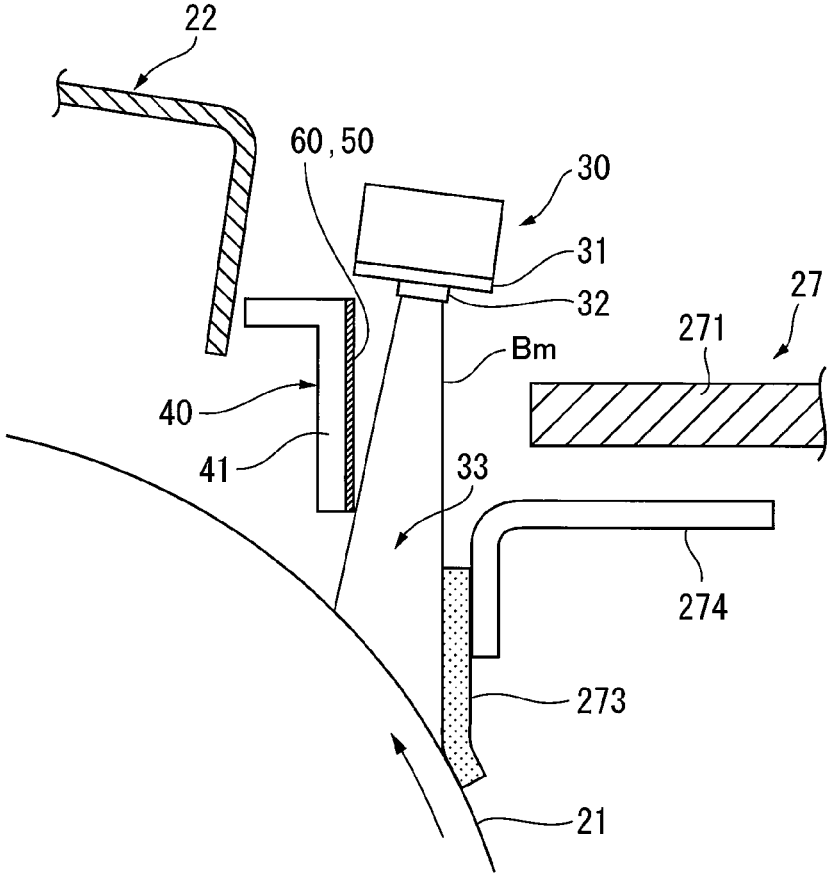
FIG. 11A illustrates the area around an optical charge-eliminating device included in an image forming apparatus according to a second exemplary embodiment.

FIG. 11A illustrates a portion of an image forming apparatus 20 according to a second exemplary embodiment (structure around an optical charge-eliminating device 30).

The basic structure of the image forming apparatus 20 illustrated in FIG. 11A is similar to that in the first exemplary embodiment except for the structure of an adjusting portion 50 formed on a light blocking plate 40. Components similar to those in the first exemplary embodiment are denoted by the same reference numerals as those in the first exemplary embodiment, and detailed description thereof will be omitted.

Figure 11B:
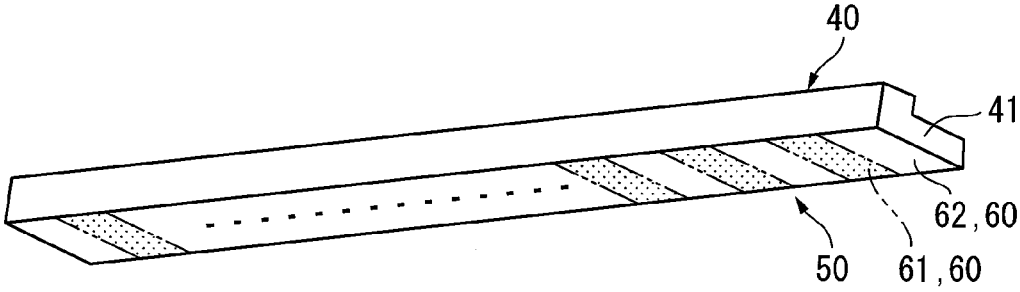
FIG. 11B illustrates the structure of a light blocking plate included in the structure illustrated in FIG. 11A.

In the present exemplary embodiment, as illustrated in FIGS. 11A and 11B, the adjusting portion 50 includes a reflection intensity distribution 60 on the partition plate portion 41 of the light blocking plate 40 that defines the radiation path of the charge-eliminating light Bm from the LED array 31. The reflection intensity distribution 60 has a periodic variation with a period equal to the arrangement pitch d1 of the LEDs 32. In this example, the reflection intensity distribution 60 is formed by alternately arranging first directional reflection elements 61, which are strip-shaped and have a low reflection intensity, and second directional reflection elements 62, which are strip-shaped and have a high reflection intensity, on a surface of the partition plate portion 41 that faces the radiation path with a period equal to the arrangement pitch d1 of the LEDs 32.

Figure 12A:
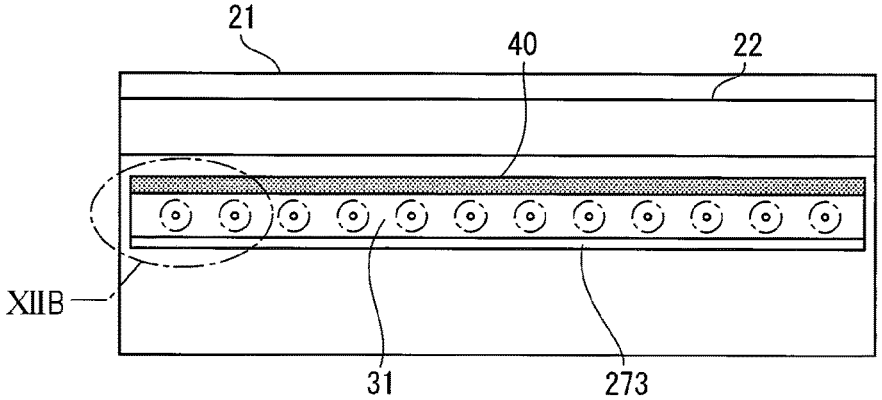
FIG. 12A is a schematic diagram corresponding to FIG. 6A, illustrating the area around the optical charge-eliminating device included in the image forming apparatus according to the second exemplary embodiment.
Figure 12B:
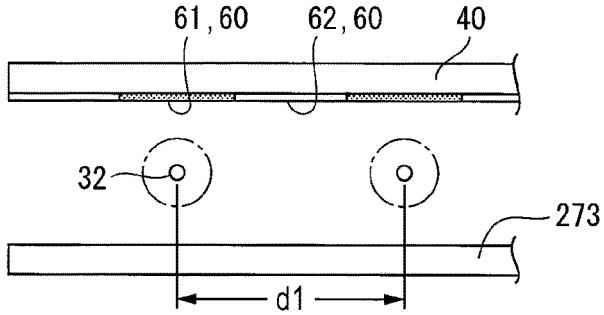
FIG. 12B is an enlarged view of part XIIB in FIG. 12A.

In this example, the first and second directional reflection elements 61 and 62 are reflective elements that are directional toward the surface of the photoconductor 21. Referring to FIGS. 12A and 12B, the first directional reflection elements 61 are arranged in regions corresponding to the arrangement positions of the LEDs 32, and the second directional reflection elements 62 are arranged in regions other than the regions corresponding to the arrangement positions of the LEDs 32.

Figure 12C:
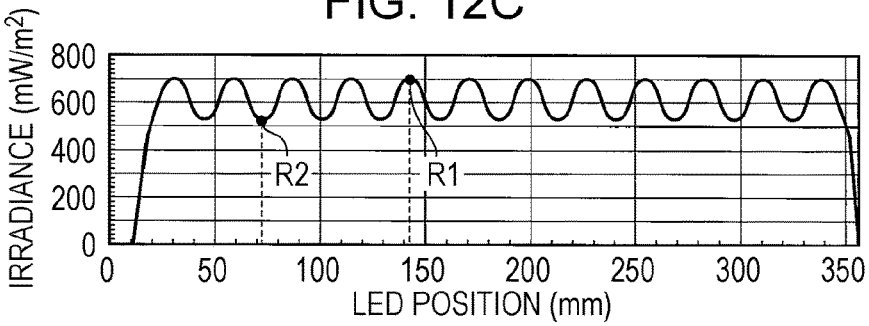
FIG. 12C is a graph showing the irradiance distribution on a photoconductor surface in an LED arrangement direction of an LED array included in the optical charge-eliminating device illustrated in FIG. 12A.

In the present exemplary embodiment, the irradiance P1 of the charge-eliminating light Bm from the LED array 31 on the photoconductor 21 periodically varies with a period equal to the arrangement pitch d1 of the LEDs 32, as illustrated in FIG. 12C. In this example, the irradiance P1 has local maximum values in regions R1 corresponding to the arrangement positions of the LEDs 32, and has local minimum values in regions R2 between the LEDs 32.

The charge-eliminating light Bm is radiated from the LEDs 32 of the LED array 31 toward the surface of the photoconductor 21 while the irradiance P1 illustrated in FIG. 12C is maintained. Since the first directional reflection elements 61 of the reflection intensity distribution 60 formed on the light blocking plate 40 have a low reflection intensity, the charge-eliminating light Bm is somewhat attenuated when reflected by the first directional reflection elements 61 in the regions R1 corresponding to the arrangement positions of the LEDs 32. Also, since the second directional reflection elements 62 of the reflection intensity distribution 60 formed on the light blocking plate 40 have a high reflection intensity, the charge-eliminating light Bm is hardly attenuated when reflected by the second directional reflection elements 62 in regions R2 other than the regions corresponding to the arrangement positions of the LEDs 32.

Figure 12D:
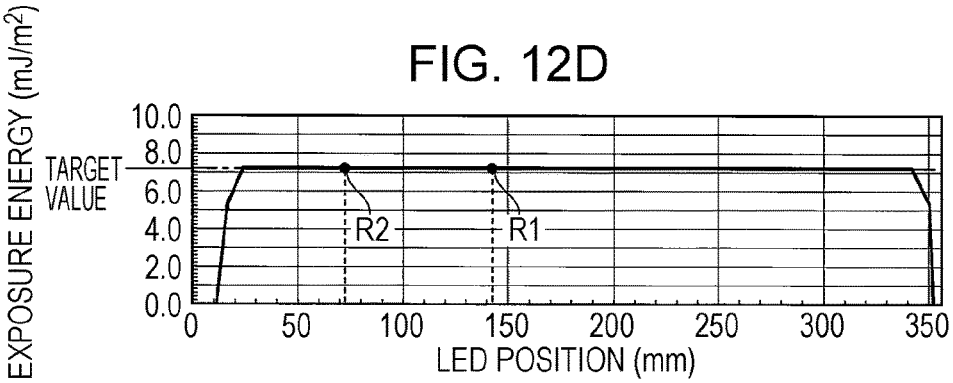
FIG. 12D is a graph showing the exposure energy distribution on the photoconductor surface in the LED arrangement direction.

Accordingly, the amount of irradiation of the surface of the photoconductor 21 by the charge-eliminating light Bm radiated from the LED array 31 is substantially the same between the regions R1 and R2. Accordingly, as illustrated in FIG. 12D, the exposure energy distribution is substantially uniform in the arrangement direction of the LEDs 32.

Third Exemplary Embodiment

Figure 13A:
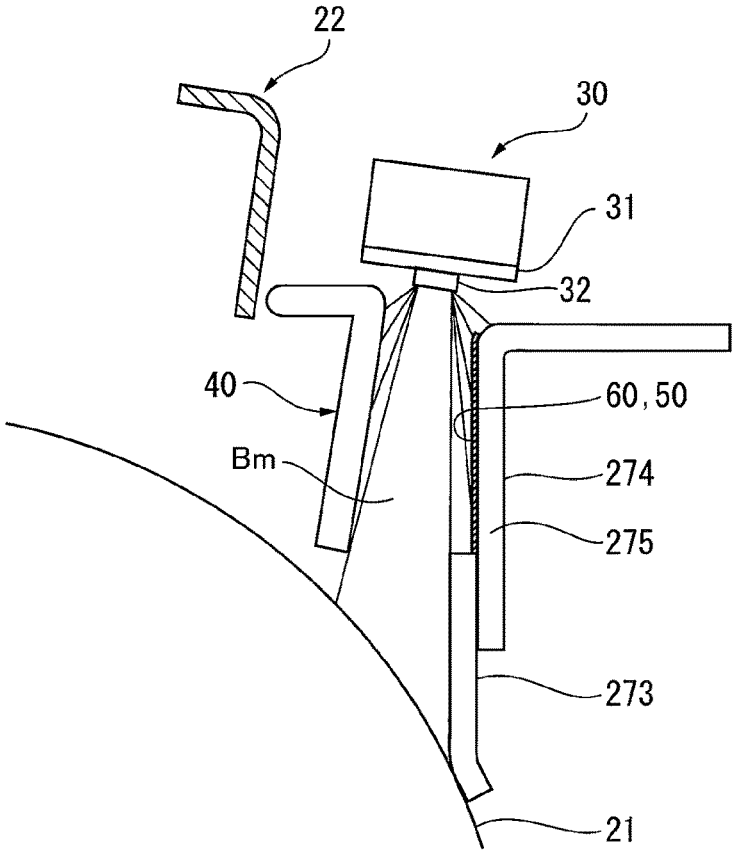
FIG. 13A illustrates the area around an optical charge-eliminating device included in an image forming apparatus according to a third exemplary embodiment.
Figure 13B:
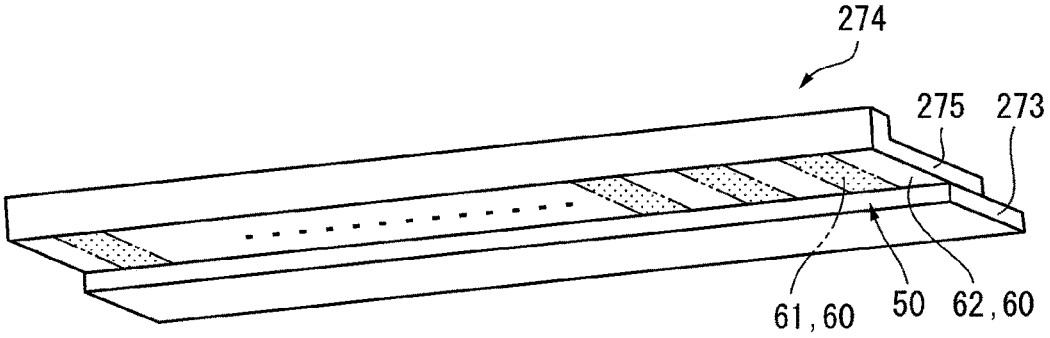
FIG. 13B illustrates the structure of a support bracket of a cleaning blade included in the structure illustrated in FIG. 13A.

FIG. 13A illustrates a portion of an image forming apparatus 20 according to a third exemplary embodiment (structure around an optical charge-eliminating device 30).

The basic structure of the image forming apparatus 20 illustrated in FIG. 13A is similar to that in the second exemplary embodiment except for the position at which the reflection intensity distribution 60, which serves as the adjusting portion 50, is formed. Components similar to those in the second exemplary embodiment are denoted by the same reference numerals as those in the second exemplary embodiment, and detailed description thereof will be omitted.

In the present exemplary embodiment, similar to the second exemplary embodiment, the cleaning device 27 includes the cleaning brush (not shown) and the cleaning blade 273 disposed in the cleaning housing (not shown). However, unlike the second exemplary embodiment, the support bracket 274 having an L-shaped cross section that supports the cleaning blade 273 includes a partition plate portion 275 that is relatively long and extends along the radiation path of the charge-eliminating light Bm from the LED array 31. The reflection intensity distribution 60, which serves as the adjusting portion 50, is formed on a surface of the partition plate portion 275 that faces the radiation path.

In this example, the reflection intensity distribution 60 is formed by alternately arranging the first directional reflection elements 61, which are strip-shaped and have a low reflection intensity, and the second directional reflection elements 62, which are strip-shaped and have a high reflection intensity, on a surface of the partition plate portion 275 that faces the radiation path with a period equal to the arrangement pitch d1 of the LEDs 32.

In this example, the first and second directional reflection elements 61 and 62 are reflective elements that are directional toward the surface of the photoconductor 21. The first directional reflection elements 61 are arranged in regions corresponding to the arrangement positions of the LEDs 32, and the second directional reflection elements 62 are arranged in regions other than the regions corresponding to the arrangement positions of the LEDs 32.

In the present exemplary embodiment, the charge-eliminating light Bm is radiated from the LED array 31 toward the surface of the photoconductor 21 while the irradiance P1 (see FIG. 12C) is maintained. The charge-eliminating light Bm is reflected by the reflection intensity distribution 60 (first directional reflection elements 61 and second directional reflection elements 62) formed on the support bracket 274 of the cleaning blade 273 in such a manner that the charge-eliminating light Bm is somewhat attenuated by the first directional reflection elements 61 and hardly attenuated by the second directional reflection elements 62.

Accordingly, the amount of irradiation of the surface of the photoconductor 21 by the charge-eliminating light Bm radiated from the LED array 31 and reflected by the reflection intensity distribution 60 formed on the support bracket 274 is substantially uniform. Accordingly, the exposure energy distribution is substantially uniform in the arrangement direction of the LEDs 32.

In the present exemplary embodiment, the reflection intensity distribution 60, which serves as the adjusting portion 50, is not provided on the light blocking plate 40. However, the reflection intensity distribution 60 may be additionally provided on the light blocking plate 40. Alternatively, the uneven portion 51 (or uneven portion 52) according to the first exemplary embodiment that serves as the adjusting portion 50 may be provided on the light blocking plate 40.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a charging member that moves;

a light source that includes a plurality of light source elements arranged at a predetermined arrangement pitch and that radiates charge-eliminating light toward the charging member;

a processing member that performs a process on a surface of the charging member at a position upstream or downstream of an irradiation region, in which the charging member is irradiated with the charge-eliminating light from the light source, in a direction in which the charging member moves;

a function member provided to enable the process of the processing member and disposed between the light source and the charging member at a position spaced from the light source, the function member facing a radiation path of the charge-eliminating light from the light source and extending in an arrangement direction in which the light source elements are arranged; and an adjusting portion formed on a surface of the function member that faces the radiation path, the adjusting portion adjusting an amount of irradiation of the charging member by the charge-eliminating light so as to reduce a difference in the amount of irradiation between regions corresponding to arrangement positions at which the light source elements are arranged and regions between the light source elements.

2. The image forming apparatus according to claim 1, wherein the adjusting portion is configured so that the surface of the function member that faces the radiation path has a periodic variation with a period equal to the arrangement pitch of the light source elements.

3. The image forming apparatus according to claim 2, wherein the adjusting portion is an uneven portion provided on the surface of the function member that faces the radiation path, the uneven portion having the periodic variation with the period equal to the arrangement pitch of the light source elements.

4. The image forming apparatus according to claim 3, wherein the uneven portion, which is the adjusting portion, has a substantially wavy shape with a substantially sinusoidal cross section.

5. The image forming apparatus according to claim 3, wherein the uneven portion, which is the adjusting portion, has a substantially wavy shape with a substantially rectangular-wave-shaped cross section.

6. The image forming apparatus according to claim 2, wherein the adjusting portion has a reflection intensity distribution on the surface of the function member that faces the radiation path, the reflection intensity distribution having the periodic variation with the period equal to the arrangement pitch of the light source elements.

7. The image forming apparatus according to claim 2, wherein the adjusting portion is formed at least on an end portion of the function member that is adjacent to the charging member.

8. The image forming apparatus according to claim 2, wherein the adjusting portion corrects the amount of irradiation by the charge-eliminating light so as to reduce a difference in the amount of irradiation by the charge-eliminating light between an end portion and a central portion in the arrangement direction of the light source elements.

9. The image forming apparatus according to claim 1, wherein the processing member is a charging device that is adjacent to the light source and that charges the charging member, and wherein the function member is a light blocking member that prevents the charge-eliminating light from the light source from irradiating a charging region in which the charging member is charged by the charging device.

10. The image forming apparatus according to claim 9, wherein the adjusting portion is integrated with the light blocking member.

11. The image forming apparatus according to claim 1, wherein the processing member is a cleaning device that is adjacent to the light source and that includes a plate-shaped cleaning member that is in contact with the charging member, and wherein the function member is a support member that supports the plate-shaped cleaning member.

12. The image forming apparatus according to claim 11, wherein the adjusting portion is provided on the support member that supports the plate-shaped cleaning member.

* * * * *